US011261622B2

(12) United States Patent
Lai

(10) Patent No.: US 11,261,622 B2
(45) Date of Patent: Mar. 1, 2022

(54) HIGH SECURITY COMBINATION PADLOCK WITH EASE OF USE RESET MECHANISM

(71) Applicant: The Sun Lock Company Limited, Tuen Mun (HK)

(72) Inventor: Karl Lai, Tai Po (HK)

(73) Assignee: The Sun Lock Company Limited, Hong Kong (HK)

( * ) Notice: Subject to any disclaimer, the term of this patent is extended or adjusted under 35 U.S.C. 154(b) by 115 days.

(21) Appl. No.: 16/914,534

(22) Filed: Jun. 29, 2020

(65) Prior Publication Data

US 2021/0062542 A1 Mar. 4, 2021

Related U.S. Application Data

(60) Provisional application No. 62/892,829, filed on Aug. 28, 2019.

(51) Int. Cl.
*E05B 37/02* (2006.01)
*E05B 67/22* (2006.01)
(Continued)

(52) U.S. Cl.
CPC ..... *E05B 37/025* (2013.01); *E05B 37/0048* (2013.01); *E05B 37/0058* (2013.01);
(Continued)

(58) Field of Classification Search
CPC ..... E05B 37/0003; E05B 37/0006; E05B 37/0048; E05B 37/0058; E05B 37/0068;
(Continued)

(56) References Cited

U.S. PATENT DOCUMENTS 2,662,385 A * 12/1953 Zavoico ..... E05B 67/02 70/52
2,893,232 A * 7/1959 Foote ..... E05B 67/22 70/38 B
(Continued)

FOREIGN PATENT DOCUMENTS

CA 3008424 A1 12/2018
EP 3199729 A1 8/2017
(Continued)

OTHER PUBLICATIONS

Extended EP Search Report dated Dec. 18, 2020 from corresponding EP Application No. 20186569.8, 9 pages.

*Primary Examiner* — Christopher J Boswell
(74) *Attorney, Agent, or Firm* — Ware, Fressola, Maguire & Barber LLP

(57) ABSTRACT

A combination lock has a body formed from a stack of plates each having various openings to form some of the channels or holes such as the locking hole to receive the short leg of the shackle, the long-leg channel, the spindle hole, the dial slots, the ratchet-pin holder slot and the bolt slots. The short leg and the long leg of the shackle each has a cutout to receive a locking bolt. The spindle has a locking surface to engage the locking bolts with the cutouts when the lock is in locked mode. The spindle also has a neck to release the locking bolts from the cutouts when the lock is in opened mode. The lock has a directional plate and a reset button near the lock's bottom end to control the rotation and the downward movement of the spindle in the reset mode.

13 Claims, 6 Drawing Sheets

(51) Int. Cl.
*E05B 37/00* (2006.01)
*E05B 67/02* (2006.01)

(52) U.S. Cl.
CPC ..... *E05B 37/0068* (2013.01); *E05B 67/02* (2013.01); *E05B 67/22* (2013.01)

(58) Field of Classification Search
CPC ..... E05B 37/02; E05B 37/025; E05B 37/10; E05B 67/02; E05B 67/22
See application file for complete search history.

(56) References Cited

U.S. PATENT DOCUMENTS

| | | | | |
|---|---|---|---|---|
| 5,175,709 | A | 12/1992 | Slayton et al. | |
| 5,953,940 | A * | 9/1999 | Ling | E05B 37/025 70/25 |
| 6,029,481 | A | 2/2000 | Lai | |
| 6,035,672 | A | 3/2000 | Lai | |
| 6,164,096 | A | 12/2000 | Lai | |
| D439,824 | S | 4/2001 | Lai | |
| D439,825 | S | 4/2001 | Lai | |
| 6,408,660 | B1 | 6/2002 | Lai | |
| 6,470,718 | B1 * | 10/2002 | Yang | E05B 67/003 70/25 |
| 6,474,116 | B1 | 11/2002 | Lai | |
| D472,790 | S | 4/2003 | Lai | |
| 6,675,614 | B2 | 1/2004 | Lai | |
| 6,729,166 | B1 | 5/2004 | Lai | |
| 6,742,366 | B1 | 6/2004 | Lai | |
| D498,132 | S | 11/2004 | Lai | |
| 6,883,355 | B2 | 4/2005 | Lai | |
| D511,673 | S | 11/2005 | Lai | |
| 7,117,698 | B2 * | 10/2006 | Lai | E05B 37/025 70/21 |
| 7,140,209 | B2 | 11/2006 | Lai | |
| 7,225,648 | B2 | 6/2007 | Lai | |
| 7,467,531 | B2 | 12/2008 | Lai et al. | |
| 7,562,545 | B2 | 7/2009 | Lai et al. | |
| 7,685,851 | B2 | 3/2010 | Lai | |
| 7,765,840 | B2 | 8/2010 | Lai et al. | |
| 8,096,150 | B2 | 1/2012 | Lai et al. | |
| 8,261,583 | B2 | 9/2012 | Lai et al. | |
| 8,511,118 | B2 | 8/2013 | Lai et al. | |
| 8,661,861 | B2 | 3/2014 | Lai | |
| 8,776,556 | B2 | 7/2014 | Lai | |
| 8,826,703 | B2 | 9/2014 | Lai | |
| 8,919,155 | B2 | 12/2014 | Lai | |
| 8,931,313 | B2 | 1/2015 | Lai | |
| 9,206,625 | B2 | 12/2015 | Lai | |
| 9,228,376 | B2 | 1/2016 | Lai | |
| 9,464,460 | B2 | 10/2016 | Lai | |
| 9,487,969 | B2 | 11/2016 | Lai | |
| 9,556,560 | B2 | 1/2017 | Lai | |
| 9,556,650 | B1 * | 1/2017 | Lai | E05B 37/025 |
| D789,174 | S | 6/2017 | Lai | |
| 9,803,398 | B2 | 10/2017 | Lai | |
| 9,890,559 | B2 | 2/2018 | Lai | |
| 10,047,541 | B2 | 8/2018 | Lai | |
| 10,221,591 | B2 | 3/2019 | Lai | |
| D864,695 | S | 10/2019 | Lai | |
| 10,443,272 | B2 | 10/2019 | Lai | |
| 11,199,025 | B2 * | 12/2021 | Lai | E05B 37/025 |
| 2006/0027001 | A1 * | 2/2006 | Lai | E05B 37/025 70/25 |
| 2007/0220929 | A1 * | 9/2007 | Green | E05B 37/025 70/25 |
| 2018/0371802 | A1 * | 12/2018 | Rodaer | E05B 67/24 |
| 2020/0318390 | A1 * | 10/2020 | Bartel | E05B 37/025 |

FOREIGN PATENT DOCUMENTS

| | | | |
|---|---|---|---|
| EP | 3786396 | A1 | 3/2021 |
| GB | 2544925 | A | 5/2017 |
| WO | 2006/016280 | A2 | 2/2006 |
| WO | 2019/094271 | A1 | 5/2019 |

* cited by examiner

HIGH SECURITY COMBINATION PADLOCK WITH EASE OF USE RESET MECHANISM

CROSS-REFERENCE TO RELATED APPLICATIONS

This application claims priority under 35 USC § 119 to U.S. Provisional Patent Application No. 62/892,829 filed on Aug. 28, 2019, the entire contents of which are hereby incorporated by reference.

TECHNICAL FIELD

The present invention is directed to padlocks, in particular hook locks.

BACKGROUND OF THE INVENTION

There are a number of mid-size padlocks currently on the market that can be considered as high security combination padlocks. However, the reset mechanism on those padlocks may not be preferable and the lock body can be improved.

SUMMARY OF THE INVENTION

The present invention includes a number of features that can enhance the security of combination padlocks and also improve the reset mechanism. The lock body of the combination lock, according to the present invention, is formed from a stack of plates securely held together with rivets. The laminated/stacked lock body construction improves the lock security. Some of the plates contain an opening for receiving the dial without exposing the ratchet pin holes. Each of the dials contains multiple faulty notches to increase the level of difficulty to pick in a laminated/stacked lock body construction. The reset mechanism containing a button at the bottom of the padlock improves the ease of reset usage.

Thus, it is an aspect of the present invention to provide a lock comprising:

a shackle having a short leg and a long leg;

a lock body formed from a stack of body-forming plates, the lock body having a first body end and an opposing second body end, the lock body comprising a long-leg channel dimensioned to receive the long leg of the shackle, the shackle locatable in a first shackle position in relationship to the lock body when the lock is operated in a locked mode and in a second shackle position when the lock is operated in an opened mode; the lock body further comprising a locking hole near the first body end dimensioned to receive the short leg of the shackle;

a first locking bolt and a second locking bolt, the short leg of the shackle having a cutout dimensioned to receive the first locking bolt, the long leg of the shackle having a cutout dimensioned to receive the second locking bolt;

a spindle locatable in a first spindle position and a second spindle position, the spindle having a first spindle end near the first body end, a second spindle end near the second body end, the spindle comprising a locking surface near the first spindle end, wherein when the spindle is located in the first spindle position, the locking surface of the spindle is arranged to engage the first locking bolt with the cutout of the short leg and the second locking bolt with the cutout of the long leg of the shackle, preventing the shackle from moving from the first shackle position to the second shackle position, and when the spindle is located in the second spindle position, the first locking bolt is released from the cutout of the short leg and the second locking bolt is released from the cutout of the long leg of the shackle, allowing the shackle to move from the first shackle position to the second shackle position;

a stack of clutches rotatably mounted on the spindle for movement together in a linear movement direction;

a plurality of dials positioned in relationship to the plurality of clutches so as to lock the spindle in the first spindle position or to allow the spindle to move in the linear movement direction from the first spindle position to the second spindle position, wherein when the spindle is located in the first spindle position, the second spindle end is located within the lock body, and when the spindle is located in the second spindle position, part of the second spindle end is located outside the lock body.

According to an embodiment of the present invention, the lock also comprises a ratchet-pin holder located inside the lock body in relationship to said plurality of dials, the ratchet-pin holder comprising a plurality of pin holes, each pin hole dimensioned to receive a pin and a spring, wherein the pin is located between the spring and one of the dials.

According to an embodiment of the present invention, the lock also has a reset pin fixedly mounted on the spindle, and a directional plate fixedly mounted on the lock body near the second body end, the directional plate having an inner surface 95 dimensioned to receive the spindle near the second spindle end, wherein the directional plate has a channel dimensioned to receive the reset pin, allowing the reset pin to move in the linear movement direction in the channel when the spindle is caused to move between the first spindle position and the second position, the reset pin preventing the spindle from a rotation movement relative to the lock body when the spindle is located in the first spindle position.

According to an embodiment of the present invention, the lock also has a bottom plug, wherein the lock body further comprises a bottom-plug hole near the second body end, the bottom-plug hole dimensioned to receive the bottom plug, wherein the directional plate is fixedly mounted on the lock body between the plurality of clutches and the bottom plug.

According to an embodiment of the present invention, the bottom plug has a rest area facing the directional plate, when the spindle is located in the second spindle position, the reset pin is arranged to move out of the channel of the directional plate and onto the rest area of the bottom plug, allowing the reset pin to move on the rest area and the spindle to rotate relative to the lock body.

According to an embodiment of the present invention, the directional plate further comprises a partial circular opening at an end of the channel, limiting movement of the reset pin on the rest area within the partial circular opening when the spindle is rotated relative to the lock body.

According to an embodiment of the present invention, the bottom plug further comprises a reset channel formed on the rest area, dimensioned to receive the reset pin, and when the reset pin is aligned with the reset channel, the spindle is allowed to move in the linear movement direction further away from the first spindle position to a reset position.

According to an embodiment of the present invention, when the spindle is located in the first spindle position or in the second spindle position, the clutches are engaged with the lock body, preventing the clutches from rotation relative to the lock body, and when the spindle is located in the reset position, the clutches are released from the lock body, allowing the clutches to rotate together with the dials relative to the spindle.

According to an embodiment of the present invention, each of the dials is associated with a different one of the clutches, and wherein each of the dials comprises one or more dial-opening slots and each of the clutches comprises at least one extended fin, and wherein when the spindle is located in first spindle position, the extended fin of each clutch is disengaged from said one or more dial-opening slots of the associated dial, allowing the dials to rotate round the clutches, when the spindle is located in the second spindle position, the extended fin of each clutch is engaged with said one or more dial-opening slots, preventing the dials from rotation around the clutches, and when the spindle is located in the reset position, the extended fin of each clutch is also engaged with said one or more dial-opening slots, allowing each of the dials to rotate together with the associated clutch relative to the spindle.

According to an embodiment of the present invention, the lock also has a rivet, and a reset button having a protrusion, wherein the second spindle end comprises a control slot and a rivet hole, the control slot dimensioned to receive the protrusion of the reset button, the rivet hole dimensioned to receive the rivet, wherein the rivet is arranged to fixedly attach the reset button to the second spindle end, causing the spindle to rotate relative to the lock body when the reset button is turned.

According to an embodiment of the present invention, when the spindle is located in the first spindle position, the reset button is adjacent to the second lock body end, and when the spindle is located in the second spindle position, the reset button is spaced from the second lock body end.

According to an embodiment of the present invention, each of the clutches comprises one or more extended fins, and the stack of clutches has a first clutch and the other clutches, the first clutch positioned adjacent to the locking surface of the spindle, and wherein the body-forming plates comprise: one or more top plates; one or more bolt plates; a plurality of clutch plates; a plurality of dial plates; a plurality of separation plates; one or more bottom plates, and one or more reset plates, wherein each top plate comprises a first opening to form part of the locking hole, and a second opening arranged to form part of the long leg channel, and a third opening dimensioned to receive the spindle;

each bolt plate comprises an elongated opening to form part of the long leg channel, part of the locking hole and to receive the first locking bolt and the second locking bolt;

each clutch plate comprises a first opening to form part of the locking hole, a second opening to form part of the long leg channel, a plurality of tooth slots dimensioned to receive said one or more extended fins of the first clutch;

each dial plate comprises a dial slot to receive a dial and an opening to form part of the long leg channel;

each separation plate comprises an opening to form part of the long leg channel, and a plurality of tooth slots dimensioned to receive said one or more extended fins of the other clutches;

each bottom plate comprises an opening dimensioned to receive the button plug, and each reset plate comprises an opening dimensioned to receive the reset button, and wherein each of the dial plates and each of the separation plates has an opening dimensioned to receive the ratchet-pin holder, and each of the body-forming plates comprises one or more body rivet holes each dimensioned to receive a body rivet arranged to hold the body-forming plates in a stack to form the lock body.

According to an embodiment of the present invention, the directional plate has a first plate end and an opposing second plate end adjacent to the bottom plug, the first plate end having one or more extended tips arranged to engage with one or more tooth slots of one or more separation plates.

The present invention will become apparent upon reading the detailed description in conjunction with the drawings.

PARTS NUMBERING

10 Padlock

Figure 1A:
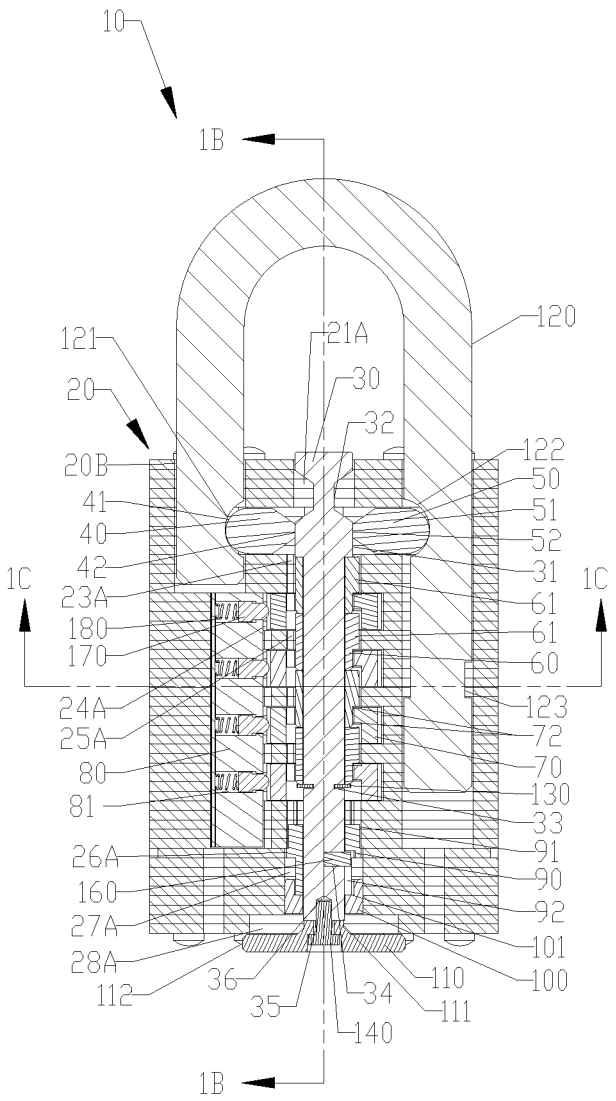
FIG. 1A is a cross-sectional view of a high security combination padlock according to an embodiment of the present invention taken along line 1A-1A of FIG. 1B.
Figure 1B:
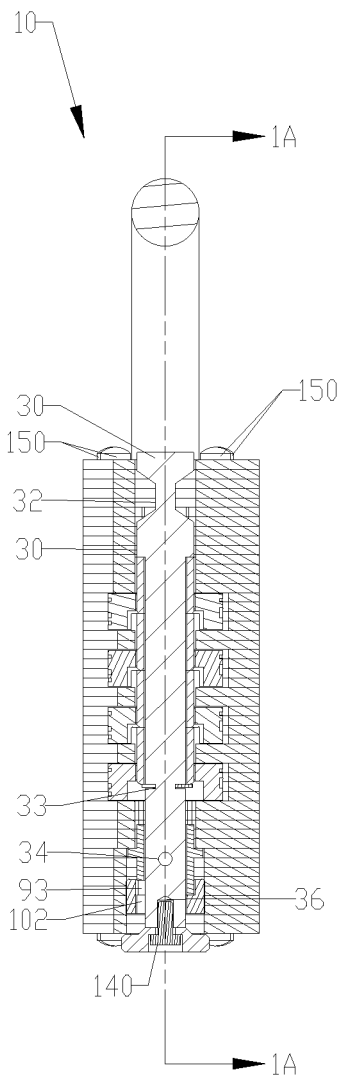
FIG. 1B is a cross-sectional view of the combination padlock taken along line 1B-1B of FIG. 1A.
Figure 1C:
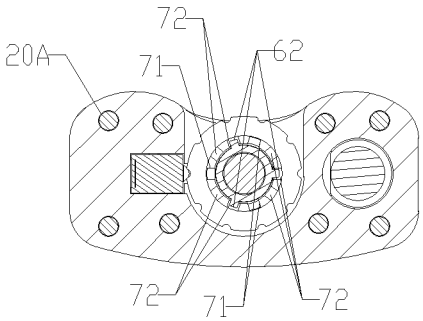
FIG. 1C is a cross-sectional view of the combination padlock taken along line 1C-1C of FIG. 1A.
Figure 2:
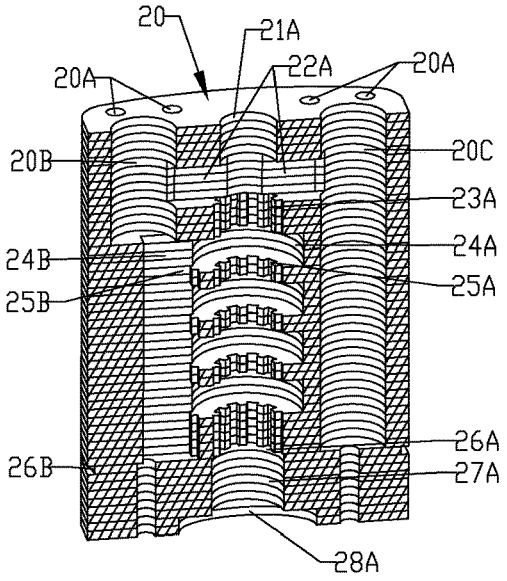
FIG. 2 is a perspective view of a lock body in the form of laminated plates forming part of the combination padlock.
Figure 3:
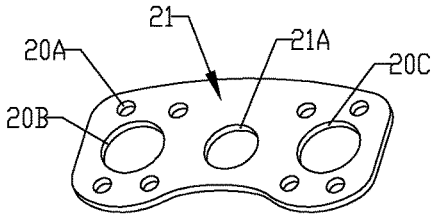
FIG. 3 is a perspective view of a top plate forming part of the combination padlock.
Figure 4:
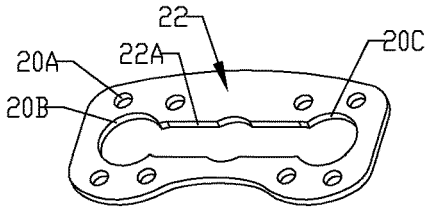
FIG. 4 is a perspective view of a bolt plate forming part of the combination padlock.
Figure 5:
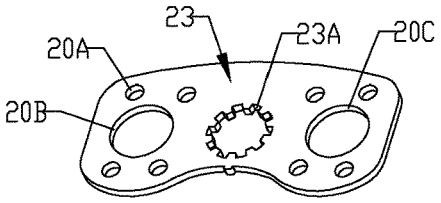
FIG. 5 is a perspective view of a clutch plate forming part of the combination padlock.
Figure 6:
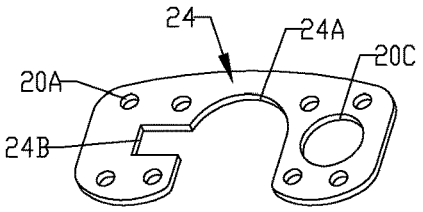
FIG. 6 is a perspective view of a dial plate forming part of the combination padlock.
Figure 7:
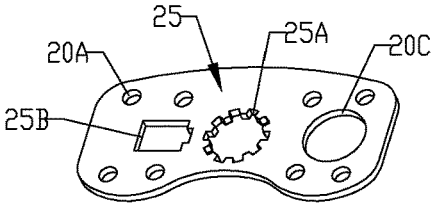
FIG. 7 is a perspective view of a separation plate forming part of the combination padlock.
Figure 8:
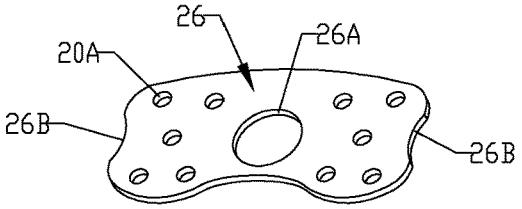
FIG. 8 is a perspective view of a cover-retain-plate forming part of the combination padlock.
Figure 9:
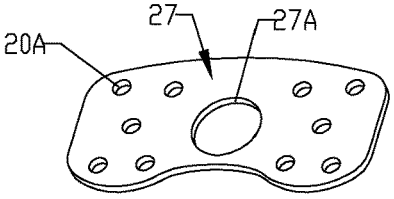
FIG. 9 is a perspective view of a bottom-plate forming part of the combination padlock.
Figure 10:
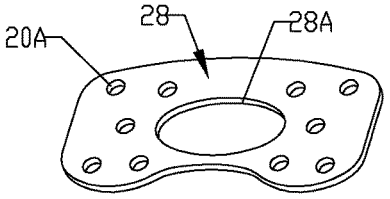
FIG. 10 is a perspective view of a reset-plate forming part of the combination padlock.
Figure 11:
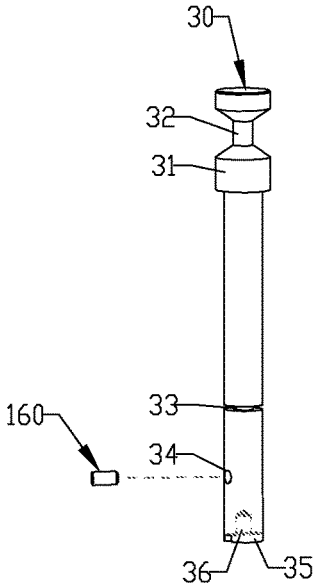
FIG. 11 is a perspective view of a spindle forming part of the combination padlock.
Figure 12:
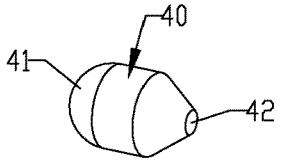
FIG. 12 is a perspective view of a short-bolt forming part of the combination padlock.
Figure 13:
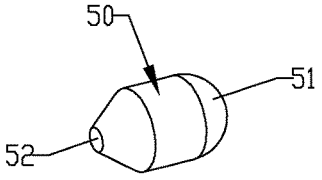
FIG. 13 is a perspective view of a long-bolt forming part of the combination padlock.
Figure 14:
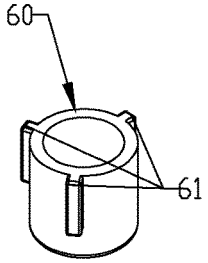
FIG. 14 is a perspective view of a clutch forming part of the combination padlock.
Figure 15A:
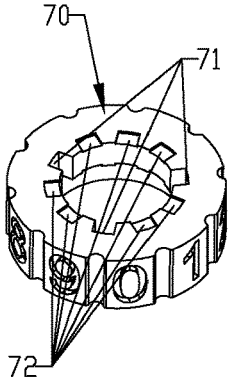
FIG. 15A is a top perspective view of a dial forming part of the combination padlock.
Figure 15B:
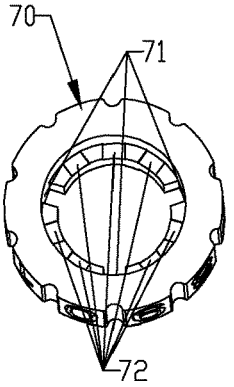
FIG. 15B is a bottom perspective view of the dial.
Figure 16:
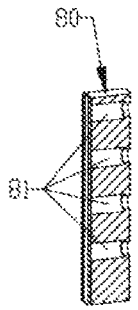
FIG. 16 is a perspective view of a ratchet-pin-holder forming part of the combination padlock.
Figure 17:
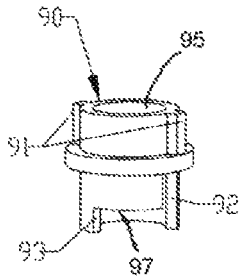
FIG. 17 is a perspective view of a directional-plate forming part of the combination padlock.
Figure 18:
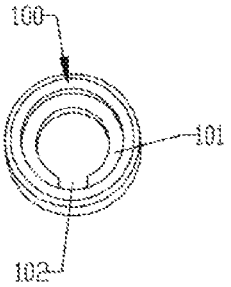
FIG. 18 is a perspective view of a bottom-plug forming part of the combination padlock.
Figure 19:
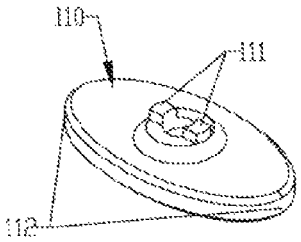
FIG. 19 is a perspective view of a reset-button forming part of the combination padlock.
Figure 20:
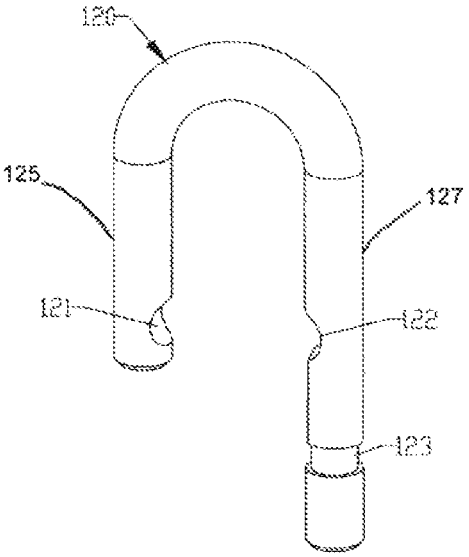
FIG. 20 is a perspective view of a shackle forming part of the combination padlock.

20 Lock Body in form of laminated/stacked plates

20A Rivet-holes 20B Short Leg Hole 20C Long-Leg Hole
21 Top Plate 21A Spindle hole
22 Bolt Plate 22A Bolt Slot
23 Clutch Plate 23A Teeth-Slot
24 Dial Plate 24A Dial Slot 24B Ratchet-pins-holder-slot
25 Separation Plate 25A Teeth-Slot 25B Ratchet-pins-holder-slot
26 Cover-Retain-Plate 26A bottom-plug-Hole 26B Cover-retain-slot
27 Bottom-Plate 27A Bottom-Plug-hole
28 Reset-Plate 28A Reset-button-hole
30 Spindle 31 Locking-Surface 32 Opening-Neck 33 C-Clip-Neck 34 Pin-Hole
35 Control-slot 36 Reset-Button-fixed-hole
40 Short-Bolt 41 Locking-Curve 42 Tail
50 Long Bolt 51 Locking-Curve 52 Tail
60 Clutch 61 Extended-Fin
70 Dial 71 Opening-Slot 72 Faulty-notches
80 Ratchet-pin-holder 81 Pin-holes
90 Directional-Plate 91 Extended-tip 92 Channel 93 Stopping-edge 95 Inner surface
97 Partial circular opening
100 Bottom-Plug 101 Rest-area 102 Channel
110 Reset-Button 111 Protrusion 112 Edge
120 Shackle 121 Locking-groove-short-leg side 122 Locking-groove-long-leg side
123 Neck 125 Short leg 127 Long leg
130 C-clip
140 Reset-button-rivet-screw
150 Body Rivet
160 Reset-Pin
170 Ratchet-pin on dial
180 Ratchet-pin Spring

DETAILED DESCRIPTION OF THE INVENTION

In the padlock 10 of the present invention, the clutches 60 cannot turn in the locked mode and in the opened mode. The lock 10 contains a series of plates which are laminated or stacked together to form a locking body 20. The lock body 20 contains more than one teeth-slot 23A/25A to allow the extended fin 61 of the clutch 60 to engage with when the lock is in the locked mode. Opening slot 71 and faulty notches 72 are made on the dial 70. The faulty notches 72 are located on both the top and bottom of the dial 70. The manufacturing of the dials 70 with both opening slot 71 and faulty notches 72 is more cost effective using current technology. In the locked mode, the turning of the dials 70 has no effect on the clutches 60 which means that an intruder cannot peek at the extended fins 61 of the clutch 60 in order to align all clutches 60 by turning the dials 70. The spindle 30 has a control-slot 35 which allows protrusion 111 of the reset-button 110 to be assembled together with a rivet-screw 140 to make the spindle 30 and the reset-button 110 in one piece. The spindle 30 has a locking surface 31 to block the tail 42/52 of bolt 40/50 so as to keep the bolt 40/50 in the lock bolt groove 121/122 of the shackle 120 when the lock is in the locked mode. The spindle 30 has a pin hole 34 to receive a reset pin 160 which is placed in a channel 92 of the directional plate 90 in the locked mode. As such, the directional plate 90 restricts the rotational movement of the spindle 30 during the locked mode. A bottom plug 100 is placed underneath the directional plate 90. The bottom plug 100 has a rest area 101 on which the reset pin 160 rests or moves during the lock opened mode. The bottom plug 100 has a channel 102 dimensioned to receive the reset pin 160 and to allow the reset pin 160 to move further downward together with the spindle 30 to cause the lock to go into the reset mode. Once the bottom plug 100 has been assembled, the directional plate 90 cannot move upward or downward. According to the present invention, when the lock 10 is in the locked mode, the spindle 30 is in the first spindle position and the lower end of the spindle 30 is located inside the lock body 20, and when the lock 10 is in the opened mode, the spindle 30 is in the second spindle position and the lower end of the spindle 30 is located outside the lock body 20. When the spindle 30 moves from the first spindle position to the second spindle position, the reset pin 160 moves downward within the channel 92 of the directional plate 90 toward the rest area 101 of the bottom plug 100. The directional plate 90 has an extended-tip 91 which engages with the teeth-slot 25A of the body 20. In this manner, the directional plate 90 cannot rotate, moving upward or downward.

Each dial 70 has at least one faulty notch 72 which helps to increase the difficulty of picking the correct combination, rendering the padlock 10 harder to pick. The lock has a stack of clutches 60 assembled around the spindle 30 between the locking-surface 31 and the C-clip 30 inserted into the C-Clip Neck 33 of the spindle 30. Also, the spindle 30, as mentioned above, has a reset pin 160 press-fitted onto the pin hole 34. After the spindle 30 is assembled with the directional plate 90 and the bottom plug 100, the reset-button 110 is mounted on the spindle 30 by a rivet-screw 140. The bottom of the spindle has a control slot 35 which is dimensioned to receive the protrusion 111 of the reset-button 110. In this manner, the rotational movement and the linear up/down movement of the reset-button 110 are directly transferred to the spindle 30. To open the lock with the correct combination, the user can push the spindle 30 downward until the reset pin 160 contacts the rest area 101 of the bottom plug 100. The user can now turn the reset button 110 together with the spindle 30 in one direction until the reset pin 160 contacts the stopping edge 93 of the directional plate 90. As the reset pin 160 hits the stopping edge 93 of the directional plate 90, the reset pin 160 aligns with the channel 102 of the bottom plug 100. In order to reset the lock, the user can further pull the reset-button 110 downward together with the spindle 30 such that the reset pin 160 falls into the channel 102 of the bottom plug 100. In the reset mode, the extended-fins 61 of the clutch 60 are disengaged from the teeth-slot 23A/25A of the lock body 20. Each of the extended-fins 61 is located inside the opening-slot 71 of the dial 70. The user can rotate the dials 70 together with the associated clutches 60 to set a new combination. The essence is that the opening slots 71 are made on the dial 70. Also, the lock body 20 has a sufficient number of the teeth-slots 23A/25A to receive the extended-fins 61 of the clutch 60 for engagement in the locked mode. If there are ten digits, characters or indicia on each dial 70, then there will be ten teeth-slots 23A/25A on the lock body 20.

According to the present invention, the lock body 20 is formed from a stack of plates 21-28, such as steel plates, riveted together. The plates 21-28 comprise rivet holes 20A to receive a number of body rivets 150. The dial plates 24 that are part of the plates forming the lock body 20 have a dials slot 24A to allow the dials 70 to be assembled onto the padlock 10. The dial slot 24A is part of the opening surface of the lock body 10.

Among the stacked plates 21-28: the top plate 21 has a spindle hole 21A, a short leg hole 20B and a long-leg hole 20C.

The bolt plate 22 has a bolt slot 22A for forming an opening to allow the bolts 40/50 to move around. The bolt plate 22 also has a short-leg-hole 20B and a long-leg hole 20C.

The clutch plate 23 has a teeth-slot 23A dimensioned to receive the extended-fins 61 of the clutch 60. The clutch plate 23 also has a short-leg hole 20B and a long-leg hole 20C.

The dial plate 24 has a dial slot 24A to receive the dial 70 and a slot 24B to receive the ratchet-pin-holder 80. The ratchet pins 170 and the spring 180 are placed inside the pin-hole 81 of the ratchet-pin holder 80. The dial plate 24 also has a long-leg hole 20C.

The separation plate 25 has a teeth-slot 25A to receive the extended-fins 61 of the clutch 60. The ratchet-pin-holders-slot 25B is also included in the separation plate 25. The separation plate 25 also has a long-leg hole 20C.

The cover-retain-plate 26 has a bottom plug-hole 26A to receive the bottom plug. The cover-retain-plate 26 also has a cover-retain-slot 26B if a cover is preferable. The slot 26B can help to snug fit the cover.

The bottom plate 27 has a bottom plug-hole 27A to receive the bottom plug 100.

The reset plate 28 has a reset-button-hole 28A.

Locked Mode (FIG. 1A-20)

The tail 42/52 of the bolt 40/50 is engaged with the locking surface 31 of the spindle 30. The locking surface 31 pushes the locking curve 41/51 of the bolt 40/50 into contact with the locking groove 121/122 of the shackle 120. When the spindle 30 is operated in this first spindle position, the shackle 120 cannot be pulled upward to release the short-leg 125 of the shackle 120 out of the short-leg hole 20B of the lock body 20. This shackle position is referred to as the first shackle position. As the stack of clutches 60 is assembled in between the locking-surface 31 of the spindle 30 and C-clip 130 inserted in the C-Clip-neck 33 of the spindle 30, the vertical movement (upward/downward movement) of the spindle 30 is only controlled by the alignment of the extended-fins 61 of the clutch 60 and the opening slots 71 of the dials 70. The extended-fins 61 of the clutch 60 are engaged with the teeth-slot 23A/25A of the lock body 20. The dial 70 has faulty notches 72 for rendering the lock hard to pick. In the locked mode, if the extended-fins 61 of one of the clutches 60 do not align with the opening slots 71 of the associated dial 70, the spindle 30 cannot be moved downward to the second spindle position to open the lock. According to the present invention, the directional plate 90 is placed underneath the C-clip 130 and a bottom plug 100 is placed underneath the directional plate 90. The directional plate 90 and the bottom plug 100 are press-fitted on the lock body 20. The reset button 110 has an edge 112 which has a dimension greater than the reset button hole 28A of the lock body 20. The reset button 110 is held by a screw-rivet 140 riveted into the reset-button-fixed-hole 36 of the spindle 30 tightly together. The reset button 110 has a protrusion 111 arranged to contact the control-slot 35 of the spindle 30. In this relationship, the user cannot cause the reset-button 110 and the spindle 30 to rotate, to move upward or downward together in the locked mode. The directional plate 90 is used to control the rotational movement of the spindle 30 and the reset button 110 only during the opened mode. The directional plate 90 has one or more extended-tips 91 arranged to engage with the teeth-slot 25A of lock body 20 so that the directional plate 90 cannot rotate in all modes. The reset pin 160 is riveted into the pin hole 34 of the spindle 30. The directional plate 90 has a channel 92 which allows the reset pin 160 to pass through between the locked mode and the opened mode. In the locked mode, the reset pin 160 is located in the channel 92 of the directional plate 90, preventing the spindle 30 and reset button 110 from rotation.

Figure 21A:
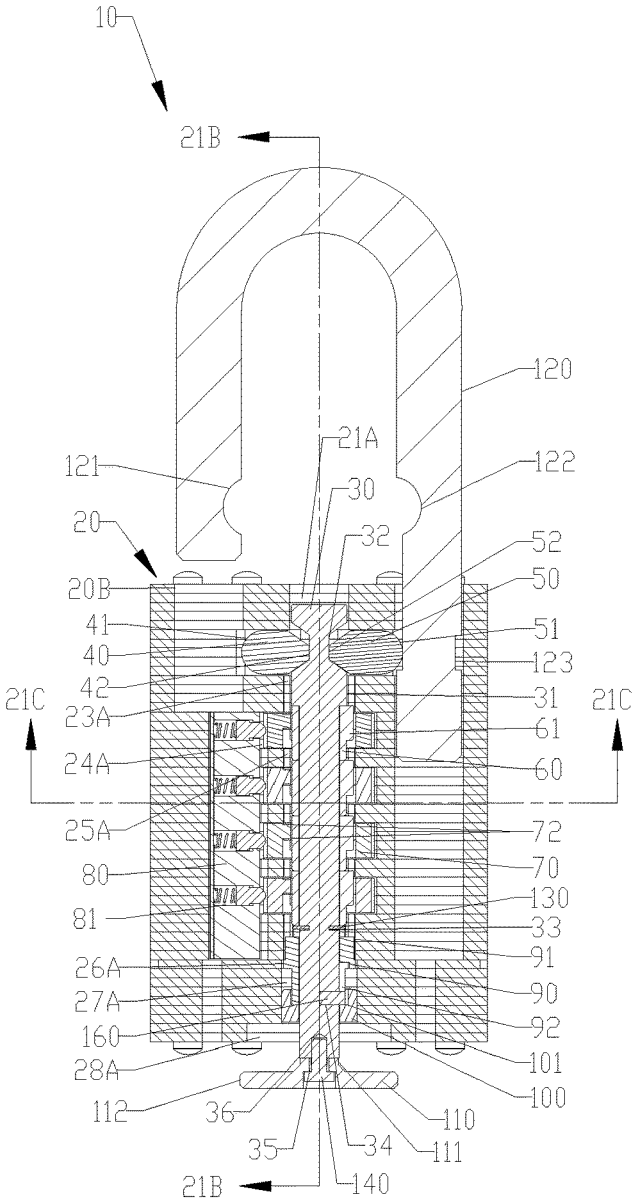
FIG. 21A is a cross-sectional view of the combination padlock taken along line 21A-21A of FIG. 21B.
Figure 21B:
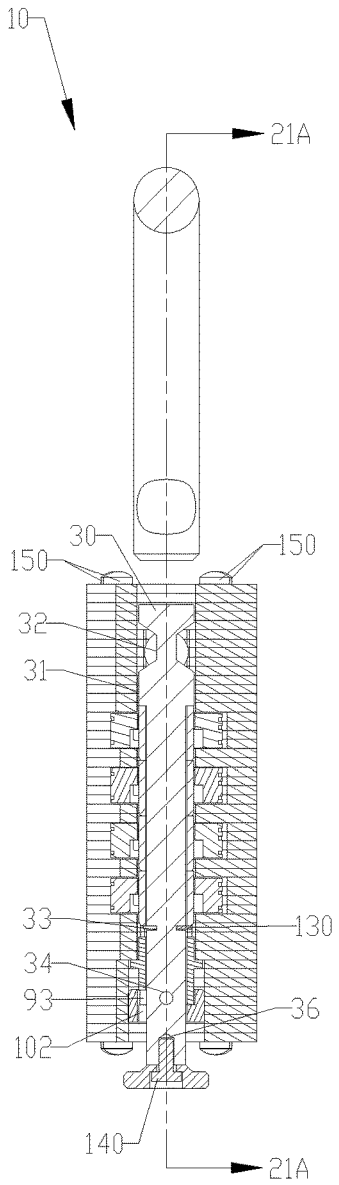
FIG. 21B is a cross-sectional view of the combination padlock taken along line 21B-21B of FIG. 21A.
Figure 21C:
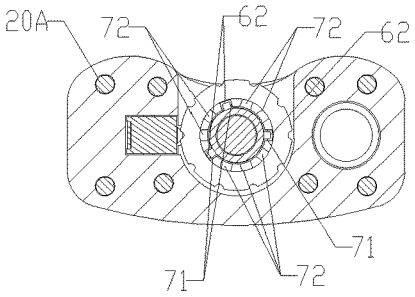
FIG. 21C is a cross-sectional view of the combination padlock taken along line 21C-21C of FIG. 21A.

Unlock by Combination Code (FIG. 21A-21C)

Each dial 70 has one or more opening-slots 71 to receive one or more extended-fins 61 of an associated clutch 60. In the opened mode, the extended-fins 61 of each of the clutches 60 are aligned with the opening slots 71 of the associated dial 70 so that the spindle 30 can be pushed downward from the first spindle position to the second spindle position for opening the padlock 10. As the spindle 30 is pushed downward, the opening neck 32 of the spindle 30 aligns with the locking bolt 40/50. This allows the bolt 40/50 to move toward the opening neck 32. As such, the bolt 40/50 is disengaged from the locking-groove 121/122 of the shackle 120. The shackle 120 can now be pulled upward to release the short leg 125 of the shackle 120 away from the short-leg locking hole 20B. The shackle 120 can continue to move upward until the locking curve 51 of the long bolt 50 contacts the neck 123 of the shackle 120. This shackle position is referred to as the second shackle position. As the spindle 30 is pushed downward from the first spindle position to the second spindle position, the reset pin 160 is also pushed downward in the channel 92 of the directional plate 90 until the reset pin 160 contacts the rest area 101 of the bottom-plug 100. The reset pin 160 on the rest area 101 stops the spindle 30 from being pushed further downward. In the unlocked or opened mode, some portion of the extended-fins 61 of the clutch 60 remains engaged in the opening-slots 71 of the dial 70, and some portion of the extended-fins 61 remains in the teeth-slot 23A/25A of the lock body 20. In this position, the dials 70 cannot rotate. This indicates that the lock is not in the reset mode. This feature prevents accidental change of the combination code.

Figure 22A:
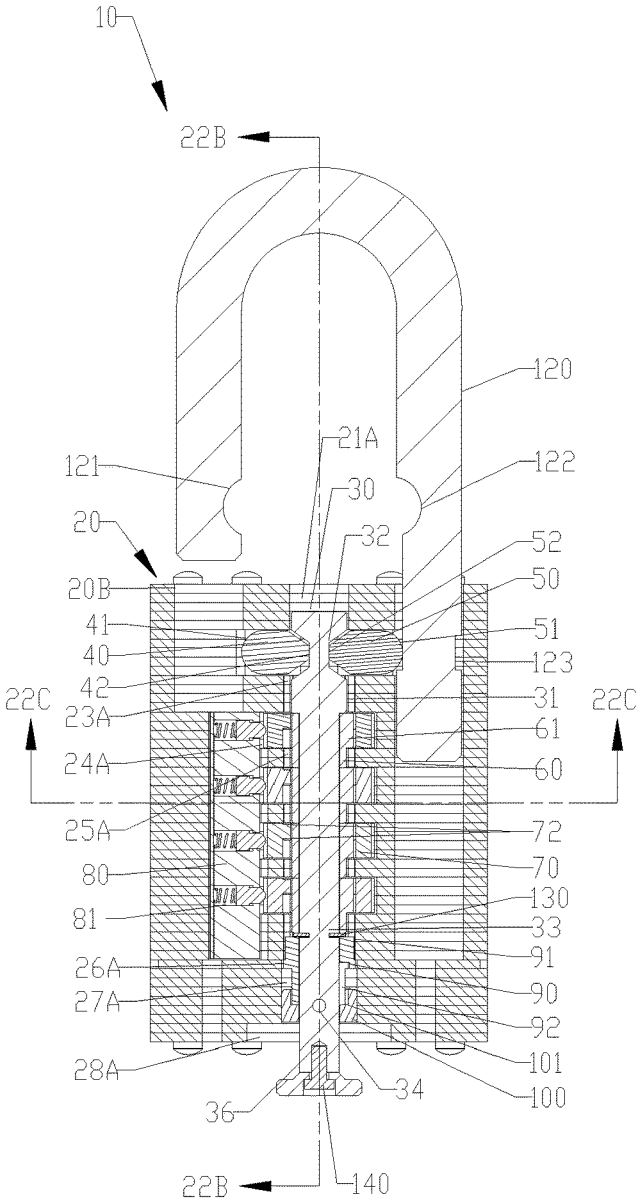
FIG. 22A is a cross-sectional view of the combination padlock taken along line 22A-22A of FIG. 22B.
Figure 22B:
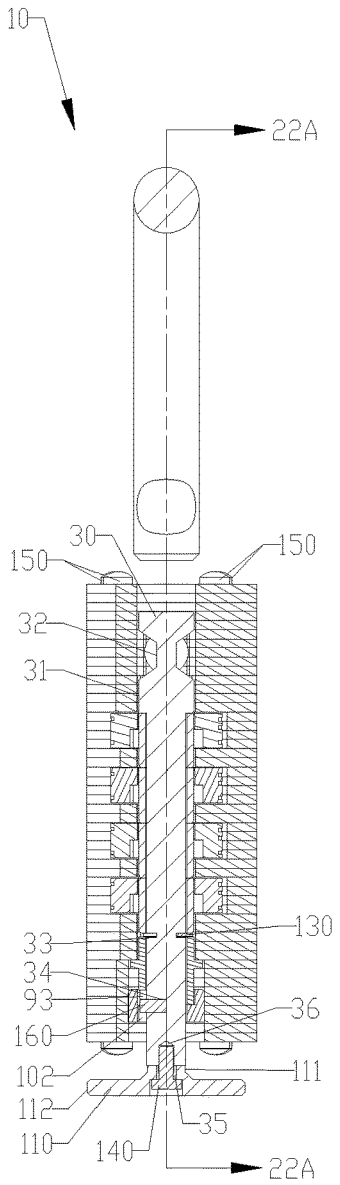
FIG. 22B is a cross-sectional view of the combination padlock taken along line 22B-22B of FIG. 22A.
Figure 22C:
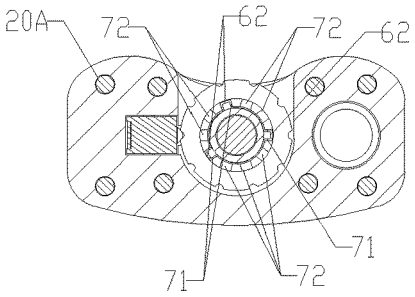
FIG. 22C is a cross-sectional view of the combination padlock taken along line 22C-22C of FIG. 22A.

Reset Combination by User (FIG. 22A-22C)

When the lock 10 is in the opened mode, the reset button 110 is spaced from the lower end of the lock body 20. To reset the lock 10, the user can rotate the reset button 110 together with the spindle 30 until the reset pin 160 contacts the stopping-edge 93 of the directional plate 90. At this position, the reset pin 160 aligns with the channel 102 of the bottom plug 100. The user can further pull the reset button 110 downward (or push the spindle 30 downward) to cause the reset pin 160 to move in the channel 102 until the C-clip 130 on the spindle 30 contacts the directional plate 90. As the spindle 30 moves downward to the reset position, the extended-fins 61 of the clutch 60 are disengaged from the teeth-slot 23A/25A of the lock body 20, while the extended-fins 61 of the clutch 60 are engaged with the opening-slots 71 of the dial 70. At such, the user can turn the dials 70 to set a new combination code. The turning of a dial 70 also rotates the opening slots 71 of the dial together with the extended-fins 61 of the associated clutch 60. After a new combination code has been set, the user can push the reset button 110 together with the spindle 30 upward so as to cause the reset pin 160 to move away from the channel 102 of the bottom plug 100 and contact the stopping edge 93 of the directional plate 90. The user can counter rotate the reset button 110 together with the spindle 30 until the reset pin 160 contacts the channel 92 of the directional plate 90. At this position, the reset pin 160 is aligned with the channel 92 of the directional plate 90. The user can push the shackle 120 back so that the short leg 125 of the shackle 120 moves back into the short-leg-locking-hole 20B. As the shackle 120 is in the locked position, the bolt 40/50 and the lock-groove 121/122 of the shackle are aligned. Then the user can push the reset button 110 together with the spindle 30 upward so as to cause the tail 42/52 of the bolt 40/50 to engage with the locking-surface 31 of the spindle 30 and the locking curve 41/51 of the bolt 40/50 to engage with the locking groove 121/122 of the shackle 120. The lock 10 is back in the locked position when the dials are scrambled.

According to the present invention, the padlock 10 comprises: i) a lock body; ii) a combination mechanism to control the movement of the bolt to control locking and unlocking; iii) more than one clutch mounted on the spindle to control the linear up/down movement of the spindle; iv) the spindle controls the locking and unlocking of the combination; v) more than one dial mounted on the lock body having one or more opening slots and faulty notches to prevent an unauthorized person from picking the correct combination; vi) locking bolts engageable with the short leg and the long leg of the shackle; vii) a spindle controls the engagement of the shackle with the locking bolts and viii) a reset button to control the reset mechanism. In the padlock, the dial has at least one faulty-notch which can prevent the intruder from picking the padlock by the "clicking" sound or feeling indicating the correct notches for opening the padlock. The dial also has at least one opening slot to receive the extended fin of the clutch to open the lock. The lock body has a teeth slot to receive the extended fin of the clutch, wherein the number of slots required in the lock body depends on the number of digits, characters or indicia on each dial. A usual numerical number dial with numbers "0, 1, 2, 3, 4, 5, 6, 7, 8, 9" has 10 slots as shown in the drawing. The spindle has a locking surface blocking the locking bolts such that the bolts engage with the locking-grooves on the shackle so as to prevent the shackle from being pulled upward to open the lock. The spindle also has an opening neck to allow the bolts to move into so as to release the locking bolts from the locking-grooves of the shackle. As such, the shackle can be pulled upward to open the lock. The spindle also has a pin hole for mounting a reset pin. The padlock has a bottom plug to control the movement of the reset pin, preventing the spindle from being further pushed downward from the locked mode to the opened mode so as to prevent the extended-fins of the clutch from engaging with the opening-slots of the dial and with the teeth-slot of the lock body. The bottom plug also has a channel such that the user can further pull the reset button along with the spindle downward so that the extended-fins of the clutches disengage from the teeth-slot of the lock body.

In summary, the padlock 10 of the present invention comprises a shackle 120 having a short leg 125 and a long leg 127; a lock body 20 formed from a stack of body-forming plates 21-28, the lock body 20 having a first body end and an opposing second body end, the lock body 20 comprising a long-leg channel 20D dimensioned to receive the long leg 127 of the shackle 120, the shackle 120 locatable in a first shackle position in relationship to the lock body 20 when the lock is operated in a locked mode (see FIG. 1A) and in a second shackle position when the lock is operated in an opened mode (see FIG. 21A); the lock body 20 further comprising a locking hole 20B near the first body end dimensioned to receive the short leg 125 of the shackle 120; a first locking bolt 40 and a second locking bolt 60, the short leg 125 of the shackle 120 having a cutout 121 dimensioned to receive the first locking bolt 40, the long leg 127 of the shackle 120 having a cutout 122 dimensioned to receive the second locking bolt 50; a spindle 30 locatable in a first spindle position (see FIG. 1A) and a second spindle position (see FIG. 21A), the spindle having a first spindle end near the first body end, a second spindle end near the second body end, the spindle 30 comprising a locking surface 31 near the first spindle end, wherein when the spindle 30 is located in the first spindle position (see FIG. 1A), the locking surface 31 of the spindle 31 is arranged to engage the first locking bolt 40 with the cutout 121 of the short leg 125 and the second locking bolt 50 with the cutout 122 of the long leg 127 of the shackle 120, preventing the shackle 120 from moving from the first shackle position to the second shackle position, and when the spindle 30 is located in the second spindle position (see FIG. 21A), the first locking bolt 40 is released from the cutout 121 of the short leg 125 and the second locking bolt 50 is released from the cutout 122 of the long leg 127 of the shackle, allowing the shackle to move from the first shackle position to the second shackle position, The lock 10 also has a stack of clutches 60 rotatably mounted on the spindle 30 for movement together in a linear up/down movement direction; a plurality of dials 70 positioned in relationship to the plurality of clutches 60 so as to lock the spindle 30 in the first spindle position or to allow the spindle 30 to move in the linear movement direction from the first spindle position to the second spindle position, wherein when the spindle 30 is located in the first spindle position, the second spindle end is located within the lock body 20 (see FIG. 1A), and when the spindle 30 is located in the second spindle position, part of the second spindle end is located outside the lock body 20 (see FIG. 21A).

As seen in FIGS. 1A and 21A, the first body end of the lock body is depicted as the top end and the second body end as the bottom end; the first spindle end is the "top" end and the second spindle end is the "bottom" end; the first spindle position is the "up" position as shown in FIG. 1A and the second spindle position is the "down" position as shown in FIG. 21A; the first shackle position is when the short leg 125 of the shackle 120 is locked in the locking hole 20B as shown in FIG. 1A, and the second shackle position is when the short leg 125 is released from the locking hole 20B as shown in FIG. 21A.

The lock 10 also has a ratchet-pin holder 80 located inside the lock body 20 in relationship to said plurality of dials 70 (see FIG. 1A), wherein the ratchet-pin holder 80 has a plurality of pin holes 81 (see FIG. 16), each pin hole 61 dimensioned to receive a pin 170 and a spring 180, wherein the pin 170 is located between the spring 180 and one of the dials 70 (See FIG. 1A). The lock 10 also has a reset pin 160 fixedly mounted on the spindle 30, and a directional plate 90 fixedly mounted on the lock body 20 near the second body end, the directional plate 90 having an inner surface 95 dimensioned to receive the spindle 30 near the second spindle end, wherein the directional plate 90 has a channel 92 dimensioned to receive the reset pin 160, allowing the reset pin 160 to move in the linear movement direction in the channel 92 when the spindle 30 is caused to move between the first spindle position and the second position. When the reset pin 160 is in the channel 92, it prevents the spindle 30 from rotating relative to the lock body 20 as the spindle 30 is located in the first spindle position. The lock 10 also has a bottom plug 100, wherein the lock body 20 also has a bottom-plug hole 27A near the second body end, the bottom-plug hole 27A dimensioned to receive the bottom plug 100, wherein the directional plate 90 is fixedly mounted on the lock body 20 between the plurality of clutches 60 and the bottom plug 100. The bottom plug 100 has a rest area 101 facing the directional plate 90, when the spindle 30 is located in the second spindle position, the reset pin 160 is arranged to move out of the channel 92 of the directional plate 90 and onto the rest area 101 of the bottom plug 100, allowing the reset pin 160 to move on the rest area 101 and the spindle 30 to rotate relative to the lock body 20.

The directional plate 90 also has a partial circular opening 97 at an end of the channel 92, limiting movement of the reset pin 160 on the rest area 101 when the spindle 30 is rotated relative to the lock body 20. The bottom plug 100 also has a reset channel 102 formed on the rest area 101, dimensioned to receive the reset pin 160 so that when the reset pin 160 is aligned with the reset channel 102, the spindle 30 is allowed to move further downward, in the linear movement direction further away from the first spindle position to a reset position (see FIG. 22A). It should be noted that when the spindle 30 is located in the first spindle position (FIG. 1A) or in the second spindle position (FIG. 21A), the clutches 60 are engaged with the lock body 20, preventing the clutches 60 from rotation relative to the lock body 20. But when the spindle 30 is located in the reset position (FIG. 22A), the clutches 60 are released from the lock body, allowing the clutches to rotate together with the dials 70 relative to the spindle 30. Each of the dials 70 is associated with a different one of the clutches 60. Each of the dials 70 has one or more dial-opening slots 71 and each of the clutches 60 has at least one extended fin 61, such that when the spindle 30 is located in first spindle position (locked mode, FIG. 1A), the extended fin 61 of each clutch 60 is disengaged from said one or more dial-opening slots 71 of the associated dial 70, allowing the dials 70 to rotate round the clutches 60, and when the spindle 30 is located in the second spindle position (opened mode, FIG. 21A), the extended fin 61 of each clutch 60 is engaged with said one or more dial-opening slots 71, preventing the dials 70 from rotation around the clutches 60. When the spindle 30 is located in the reset position (FIG. 22A), the extended fin 61 of each clutch 60 is also engaged with said one or more dial-opening slots 71, allowing each of the dials 70 to rotate together with the associated clutch 60 relative to the spindle 30.

The lock 20 also has a rivet 140, and a reset button 111 with a protrusion 111, wherein the second spindle end has a control slot 35 and a rivet hole 35, the control slot 36 dimensioned to receive the protrusion 111 of the reset button 111, the rivet hole 35 dimensioned to receive the rivet 140, wherein the rivet 140 is arranged to fixedly attach the reset button 111 to the second spindle end of the spindle 30, causing the spindle 30 to rotate relative to the lock body 20 when the reset button 111 is turned. When the spindle 30 is located in the first spindle position, the reset button 111 is adjacent to the second lock body end (see FIG. 1A), and when the spindle 30 is located in the second spindle position, the reset button 111 is spaced from the second lock body end (see FIG. 21A). The stack of clutches 60 has a first clutch (the top one) and the other clutches 60, the first clutch positioned adjacent to the locking surface 31 of the spindle 30, and wherein the body-forming plates 21-28 include: one or more top plates 21; one or more bolt plates 22; a plurality of clutch plates 23; a plurality of dial plates 24; a plurality of separation plates 24; one or more bottom plates 24, and one or more reset plates 28, wherein each top plate 21 has a first opening 20B to form part of the locking hole, and a second opening 20C arranged to form part of the long leg channel 20D, and a third opening 21A dimensioned to receive the spindle 30; each bolt plate 22 has an elongated opening 22A to form part of the long leg channel, part of the locking hole and to receive the first locking bolt 40 and the second locking bolt 50; each clutch plate 23 has a first opening 20B to form part of the locking hole, a second opening 20C to form part of the long leg channel, a plurality of tooth slots 23A dimensioned to receive said one or more extended fins 61 of the first clutch; each dial plate 24 has a dial slot 24A to receive a dial 70 and an opening 24C to form part of the long leg channel; each separation plate 25 has an opening 20C to form part of the long leg channel, and a plurality of tooth slots 23A dimensioned to receive said one or more extended fins 61 of the other clutches; each bottom plate 27 has an opening 27A dimensioned to receive the button plug 100, and each reset plate 28 has an opening 28A dimensioned to receive the reset button 110, and wherein each of the dial plates 24 and each of the separation plates 25 has an opening 24B, 25B dimensioned to receive the ratchet-pin holder 80, and each of the body-forming plates 21-28 has one or more body rivet holes 20A each dimensioned to receive a body rivet 150 arranged to hold the body-forming plates 21-28 in a stack to form the lock body 20. The directional plate 90 has a first plate end and an opposing second plate end adjacent to the bottom plug 100, the first plate end having one or more extended tips 91 arranged to engage with one or more tooth slots 25A of one or more separation plates 25.

What is claimed is:

1. A lock comprising:

a shackle having a short leg and a long leg;

a lock body formed from a stack of body-forming plates, the lock body having a first body end and an opposing second body end, the lock body comprising a long-leg channel dimensioned to receive the long leg of the shackle, the shackle locatable in a first shackle position in relationship to the lock body when the lock is operated in a locked mode and in a second shackle position when the lock is operated in an opened mode; the lock body further comprising a locking hole near the first body end dimensioned to receive the short leg of the shackle;

a first locking bolt and a second locking bolt, the short leg of the shackle having a cutout dimensioned to receive the first locking bolt, the long leg of the shackle having a cutout dimensioned to receive the second locking bolt;

a spindle locatable in a first spindle position and a second spindle position, the spindle having a first spindle end near the first body end, a second spindle end near the second body end, the spindle comprising a locking surface near the first spindle end, wherein when the spindle is located in the first spindle position, the locking surface of the spindle is arranged to engage the first locking bolt with the cutout of the short leg and the second locking bolt with the cutout of the long leg of the shackle, preventing the shackle from moving from the first shackle position to the second shackle position, and when the spindle is located in the second spindle position, the first locking bolt is released from the cutout of the short leg and the second locking bolt is released from the cutout of the long leg of the shackle, allowing the shackle to move from the first shackle position to the second shackle position;

a stack of clutches rotatably mounted on the spindle for movement together in a linear movement direction;

a plurality of dials positioned in relationship to the plurality of clutches so as to lock the spindle in the first spindle position or to allow the spindle to move in the linear movement direction from the first spindle position to the second spindle position, wherein when the spindle is located in the first spindle position, the second spindle end is located within the lock body, and when the spindle is located in the second spindle position, part of the second spindle end is located outside the lock body.

2. The lock according to claim 1, further comprising: a ratchet-pin holder located inside the lock body in relationship to said plurality of dials, the ratchet-pin holder comprising a plurality of pin holes, each pin hole dimensioned to receive a pin and a spring, wherein the pin is located between the spring and one of the dials.

3. The lock according to claim 1, further comprising: a reset pin fixedly mounted on the spindle, and a directional plate fixedly mounted on the lock body near the second body end, the directional plate having an inner surface dimensioned to receive the spindle near the second spindle end, wherein the directional plate has a channel dimensioned to receive the reset pin, allowing the reset pin to move in the linear movement direction in the channel when the spindle is caused to move between the first spindle position and the second position, the reset pin preventing the spindle from a rotation movement relative to the lock body when the spindle is located in the first spindle position.

4. The lock according to claim 3, further comprising a bottom plug, wherein the lock body further comprises a bottom-plug hole near the second body end, the bottom-plug hole dimensioned to receive the bottom plug, wherein the directional plate is fixedly mounted on the lock body between the plurality of clutches and the bottom plug.

5. The lock according to claim 4, wherein the bottom plug has a rest area facing the directional plate, when the spindle is located in the second spindle position, the reset pin is arranged to move out of the channel of the directional plate and onto the rest area of the bottom plug, allowing the reset pin to move on the rest area and the spindle to rotate relative to the lock body.

6. The lock according to claim 5, wherein the directional plate further comprises a partial circular opening at an end of the channel, limiting movement of the reset pin on the rest area within the partial circular opening when the spindle is rotated relative to the lock body.

7. The lock according to claim 5, wherein the bottom plug further comprises a reset channel formed on the rest area, dimensioned to receive the reset pin, and when the reset pin is aligned with the reset channel, the spindle is allowed to move in the linear movement direction further away from the first spindle position to a reset position.

8. The lock according to claim 7, wherein when the spindle is located in the first spindle position or in the second spindle position, the clutches are engaged with the lock body, preventing the clutches from rotation relative to the lock body, and when the spindle is located in the reset position, the clutches are released from the lock body, allowing the clutches to rotate together with the dials relative to the spindle.

9. The lock according to claim 8, wherein each of the dials is associated with a different one of the clutches, and wherein each of the dials comprises one or more dial-opening slots and each of the clutches comprises at least one extended fin, and wherein when the spindle is located in first spindle position, the extended fin of each clutch is disengaged from said one or more dial-opening slots of the associated dial, allowing the dials to rotate round the clutches, when the spindle is located in the second spindle position, the extended fin of each clutch is engaged with said one or more dial-opening slots, preventing the dials from rotation around the clutches, and when the spindle is located in the reset position, the extended fin of each clutch is also engaged with said one or more dial-opening slots, allowing each of the dials to rotate together with the associated clutch relative to the spindle.

10. The lock according to claim 3, wherein each of the clutches comprises one or more extended fins, and the stack of clutches has a first clutch and the other clutches, the first clutch positioned adjacent to the locking surface of the spindle, and wherein the body-forming plates comprise:

one or more top plates;

one or more bolt plates;

a plurality of clutch plates;

a plurality of dial plates;

a plurality of separation plates;

one or more bottom plates, and one or more reset plates, wherein each top plate comprises a first opening to form part of the locking hole, and a second opening arranged to form part of the long leg channel, and a third opening dimensioned to receive the spindle;

each bolt plate comprises an elongated opening to form part of the long leg channel, part of the locking hole and to receive the first locking bolt and the second locking bolt;

each clutch plate comprises a first opening to form part of the locking hole, a second opening to form part of the long leg channel, a plurality of tooth slots dimensioned to receive said one or more extended fins of the first clutch;

each dial plate comprises a dial slot to receive a dial and an opening to form part of the long leg channel;

each separation plate comprises an opening to form part of the long leg channel, and a plurality of tooth slots dimensioned to receive said one or more extended fins of the other clutches;

each bottom plate comprises an opening dimensioned to receive the button plug, and each reset plate comprises an opening dimensioned to receive the reset button, and wherein each of the dial plates and each of the separation plates has an opening dimensioned to receive the ratchet-pin holder, and each of the body-forming plates comprises one or more body rivet holes each dimensioned to receive a body rivet arranged to hold the body-forming plates in a stack to form the lock body.

11. The lock according to claim 10, wherein the directional plate has a first plate end and an opposing second plate end adjacent to the bottom plug, the first plate end having one or more extended tips arranged to engage with one or more tooth slots of one or more separation plates.

12. The lock according to claim 1, further comprising:

a rivet, and a reset button having a protrusion, wherein the second spindle end comprises a control slot and a rivet hole, the control slot dimensioned to receive the protrusion of the reset button, the rivet hole dimensioned to receive the rivet, wherein the rivet is arranged to fixedly attach the reset button to the second spindle end, causing the spindle to rotate relative to the lock body when the reset button is turned.

13. The lock according to claim 12, wherein when the spindle is located in the first spindle position, the reset button is adjacent to the second lock body end, and when the spindle is located in the second spindle position, the reset button is spaced from the second lock body end.

* * * * *